US007365710B2

(12) United States Patent
Chung et al.

(10) Patent No.: US 7,365,710 B2
(45) Date of Patent: Apr. 29, 2008

(54) PLASMA DISPLAY PANEL DRIVING METHOD AND PLASMA DISPLAY DEVICE

(75) Inventors: Woo-Joon Chung, Suwon-si (KR); Jin-Sung Kim, Suwon-si (KR); Kyoung-Ho Kang, Suwon-si (KR); Seung-Hun Chae, Suwon-si (KR); Tae-Seong Kim, Suwon-si (KR)

(73) Assignee: Samsung SDI Co. Ltd., Suwon-si (KR)

( * ) Notice: Subject to any disclaimer, the term of this patent is extended or adjusted under 35 U.S.C. 154(b) by 573 days.

(21) Appl. No.: 10/936,014

(22) Filed: Sep. 8, 2004

(65) Prior Publication Data

US 2005/0052347 A1 Mar. 10, 2005

(30) Foreign Application Priority Data

Sep. 9, 2003 (KR) ..... 10-2003-0063134
Oct. 31, 2003 (KR) ..... 10-2003-0076979

(51) Int. Cl.
*G09G 3/28* (2006.01)

(52) U.S. Cl. ..... 345/60; 345/67; 345/68

(58) Field of Classification Search ..... 345/60, 345/67–68

See application file for complete search history.

(56) References Cited

U.S. PATENT DOCUMENTS 5,745,086 A 4/1998 Weber
7,012,579 B2 * 3/2006 Choi ..... 345/60

FOREIGN PATENT DOCUMENTS

JP 2000-305510 11/2000
JP 2003-295814 10/2003

OTHER PUBLICATIONS

Patent Abstracts of Japan for Publication No. 2000-305510, Date of publication of application Nov. 2, 2000,, in the name of K. Ito et al.
Patent Abstracts of Japan for Publication No. 2003-295814; Date of publication of application Oct. 15, 2003, in the name of Mitsuyoshi Makino.

* cited by examiner

*Primary Examiner*—Richard Hjerpe
*Assistant Examiner*—Leonid Shapiro
(74) *Attorney, Agent, or Firm*—Christie, Parker & Hale, LLP

(57) ABSTRACT

A PDP driving method. A falling ramp voltage is applied to a scan electrode so as to reset a state of wall charges of a discharge cell during a reset period. In this instance, a sustain electrode is maintained at a high voltage during an initial period for applying the falling ramp voltage, and the voltage at the sustain electrode is reduced to a normal voltage at a latter part of the period for applying the falling ramp voltage. Accordingly, the voltage applied to an address electrode is reduced in an address period since an erased amount of the wall charges of the address electrode is reduced during the reset period.

9 Claims, 7 Drawing Sheets

PLASMA DISPLAY PANEL DRIVING METHOD AND PLASMA DISPLAY DEVICE

CROSS REFERENCE TO RELATED APPLICATION

This application claims priority to and the benefit of Korea Patent Application Nos. 2003-63134 and 2003-76979 filed on Sep. 9, 2003 and Oct. 31, 2003, respectively, in the Korean Intellectual Property Office, the entire contents of both of which are incorporated herein by reference.

BACKGROUND OF THE INVENTION (a) Field of the Invention

The present invention relates to a PDP (plasma display panel) driving method and a plasma display device.

(b) Description of the Related Art

A PDP is a flat display for showing characters or images using plasma generated by gas discharge. PDPs can include pixels numbering more than several million in a matrix format, in which the number of pixels are determined by the size of the PDP. Referring to FIGS. 1 and 2, a PDP structure will now-be described.

FIG. 1 shows a partial perspective view of the PDP, and FIG. 2 schematically shows an electrode arrangement of the PDP.

As shown in FIG. 1, the PDP includes glass substrates 1 and 6 facing each other with a predetermined gap therebetween. Scan electrodes 4 and sustain electrodes 5 in pairs are formed in parallel on glass substrate 1, and scan electrodes 4 and sustain electrodes 5 are covered with dielectric layer 2 and protection film 3. A plurality of address electrodes 8 is formed on glass substrate 6, and address electrodes 8 are covered with insulator layer 7. Barrier ribs 9 are formed on insulator layer 7 between address electrodes 8, and phosphors 10 are formed on the surface of insulator layer 7 and between barrier ribs 9. Glass substrates 1 and 6 are provided facing each other with discharge spaces between glass substrates 1 and 6 so that scan electrodes 4 and sustain electrodes 5 can cross address electrodes 8. Discharge space 11 between address electrode 8 and a crossing part of a pair of scan electrode 4 and sustain electrode 5 forms discharge cell 12, which is schematically indicated.

As shown in FIG. 2, the electrodes of the PDP have an n×m matrix format. Address electrodes $A_1$ to $A_m$ are arranged in the column (vertical) direction, and n scan electrodes $Y_1$ to $Y_n$ and n sustain electrodes $X_1$ to $X_n$ are arranged in pairs in the row (horizontal) direction. Scan/sustain driving circuit 13 is coupled to scan electrodes $Y_1$ to $Y_n$ and sustain electrodes $X_1$ to $X_n$, and address driving circuit 15 is coupled to address electrodes $A_1$ to $A_m$.

In the general PDP, a frame is divided into a plurality of subfields and then driven, and gray scales are displayed by combination of the subfields. Each subfield includes a reset period, an address period, and a sustain period. In the reset period, wall charges formed by a previous sustain discharging are erased, and wall charges are set up so as to perform a next stable address discharging. In the address period, cells which are turned on and cells which are not turned on are selected, and the wall charges are accumulated on the turned-on cells (addressed cells). In the sustain period, a sustain discharging for displaying the actual image on the addressed cells is executed.

As shown in FIG. 3, the reset period includes a rising ramp period and a falling ramp period. In the rising ramp period, a ramp voltage gradually rises to voltage $V_{set}$ from voltage $V_s$ while address electrode A and sustain electrode X are maintained at 0V. While the ramp voltage rises, a weak reset discharging is generated to address electrode A and sustain electrode X from scan electrode Y in all the discharge cells. As a result, negative wall charges are accumulated on scan electrode Y, and positive wall charges are accumulated on address electrode A and sustain electrode X. More accurately, the wall charges are accumulated on protection film 3 which covers scan electrode Y and sustain electrode X and on insulator layer 7 which covers address electrode A. For ease of description, the wall charges are described to be accumulated on scan electrode Y, sustain electrode X, and address electrode A.

A ramp voltage which gradually falls to 0V from voltage $V_s$ is applied to scan electrode Y while sustain electrode X is maintained at voltage $V_e$ in the falling ramp period. While the ramp voltage falls, a weak reset discharging is generated in all the discharge cells. As a result, the negative wall charges on scan electrode Y are reduced, and the positive wall charges on sustain electrode X and address electrode A are reduced.

In this instance, it is required that a high voltage be applied to address electrode A for the address discharging during the address period since a large amount of charges are erased from among the positive wall charges accumulated on address electrode A according to the conventional waveform. That is, a switch having a high withstand voltage needs to be used by a circuit applying a voltage to address electrode A, and power consumption is also increased because of the high voltage.

SUMMARY OF THE INVENTION

In accordance with the present invention a PDP driving method is provided for generating address discharging by using a low voltage.

In the present invention, the voltage applied to the sustain voltage is increased during a partial latter part of the reset period.

In one aspect of the present invention, a method is provided for driving a PDP which includes a plurality of first and second electrodes formed in parallel, and a plurality of third electrodes which cross the first and second electrode. The adjacent first electrode, the second electrode, and the address electrode form a discharge cell. A voltage at the first electrode is gradually reduced to a second voltage in a reset period. A third voltage and a fourth voltage are respectively applied to the first electrode and the third electrode of the discharge cell to be selected from among the discharge cells in an address period. The second electrode is maintained at a fifth voltage for a predetermined time, and a sixth voltage which is less than the fifth voltage is applied to the second electrode while the voltage at the first electrode falls to the second voltage from first voltage.

The sixth voltage is a voltage having the same level as that of the voltage applied to the second electrode during the address period.

In addition, a seventh voltage greater than the sixth voltage is applied to the second electrode during the address period, and the seventh voltage is a voltage with the same level as that of the fifth voltage.

Also, the fifth voltage is a voltage with the same level as that of the voltage applied for the sustain discharge to the second electrode during the sustain period.

The voltage applied to the second electrode is varied stepwise to from the sixth voltage to the fifth voltage, or the second electrode is floated and the fifth voltage is applied to the second electrode after the predetermined time.

The voltage applied to the second electrode gradually falls from the sixth voltage to the fifth voltage. The gradient falling to the fifth voltage from the sixth voltage corresponds to the gradient falling to the second voltage from the first voltage.

The voltage at the first electrode gradually falls to the second voltage from the first voltage on at least one slope. The step of gradually reducing a voltage at the first electrode to a second voltage from a first voltage includes repeating a period for reducing the voltage at the first electrode by a predetermined voltage and a period for floating the first electrode.

In another aspect of the present invention, a plasma display device is provided which includes a plurality of first and second electrodes formed in parallel, and a plurality of third electrodes which cross the first and second electrodes; and a driving circuit for applying driving signals to the first, second, and third electrodes. The driving circuit gradually reduces a voltage at the first electrode to the second voltage from the first voltage, and modifies a voltage at the second electrode to the fourth voltage from the third voltage while the voltage at the first electrode is varied to the second voltage from the first voltage.

DETAILED DESCRIPTION

Figure 4:
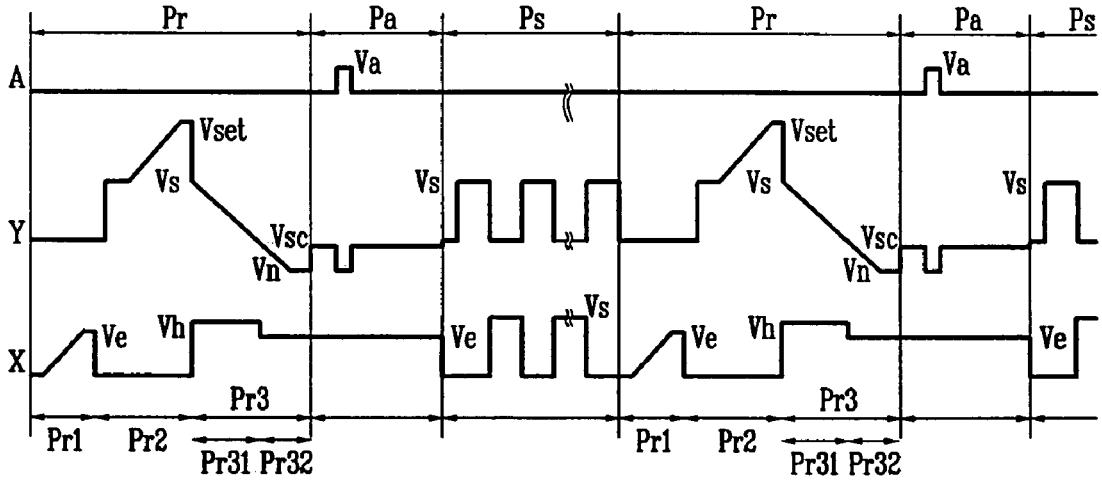
FIG. 4 shows a PDP driving waveform diagram according to a first exemplary embodiment of the present invention.

Referring now to FIG. 4, each subfield in the driving waveform according to the first exemplary embodiment of the present invention includes reset period $P_r$, address period $P_a$, and sustain period $P_s$. reset period $P_r$ includes erase period $P_{r1}$, rising period $P_{r2}$, and falling period $P_{r3}$.

Erase period $P_{r1}$ of reset period $P_r$ is for erasing the charges formed by a sustain discharging in sustain period $P_s$ of a previous subfield. Rising period $P_{r2}$ is a period for forming wall charges on scan electrode Y, sustain electrode X, and address electrode A. Falling period $P_{r3}$ is a period for erasing part of the wall charges formed in rising period $P_{r2}$ to thus support the address discharging. Address period $P_a$ is a period for selecting a discharge cell to be sustained in the sustain period from among a plurality of discharge cells. Sustain period $P_s$ is a period for alternately applying a sustain pulse to scan electrode Y and sustain electrode X to sustain-discharge the discharge cell selected in address period $P_a$.

Figure 1:
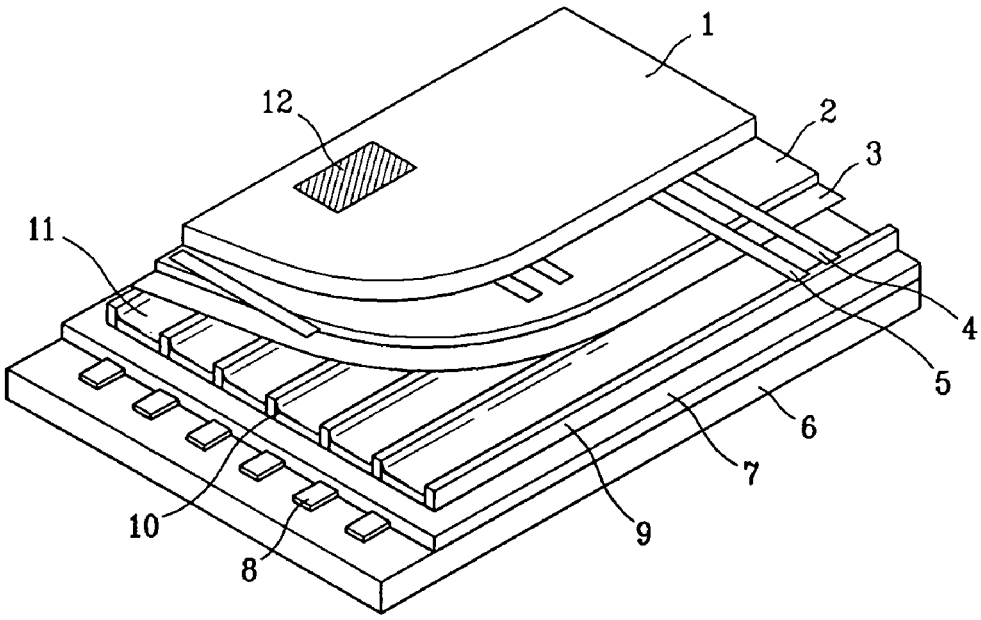
FIG.1(Prior Art)
FIG. 1 shows a partial brief perspective view diagram of a PDP.
Figure 2:
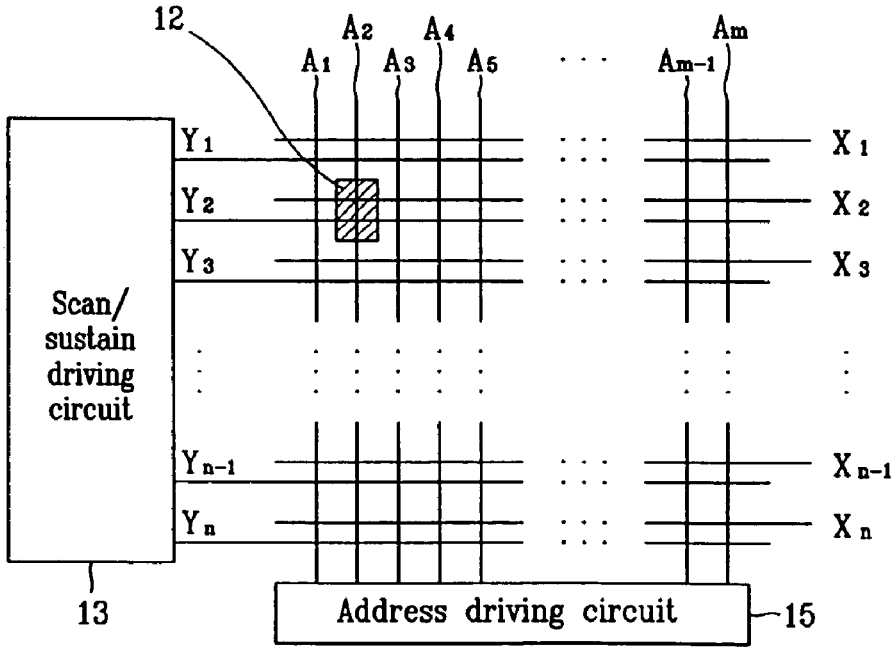
FIG.2(Prior Art)
FIG. 2 shows an electrode arrangement diagram of a PDP.

Scan/sustain driving circuit 13 shown in FIG. 2 for applying a driving voltage to scan electrode Y and sustain electrode Y in respective periods $P_r$, $P_a$, and $P_s$, and address driving circuit 15 shown in FIG. 2 for applying a driving circuit to address electrode A are coupled to the PDP to thus configure a displaying device.

Still referring to FIG. 4, voltage $V_h$ which is greater than voltage $V_e$ by voltage $V_p$ is applied to sustain electrode X during period $P_{r31}$ which corresponds to the initial part of falling period $P_{r3}$, and voltage $V_e$ is applied to sustain electrode X during second period $P_{r32}$ which corresponds to the latter part of falling period $P_{r3}$ in the driving waveform according to the first exemplary embodiment of the present invention. A ramp voltage which gradually falls to the reference voltage from voltage $V_s$ is applied to scan electrode Y. The above-noted ramp voltage falls with a predetermined gradient or with a variable gradient. Accordingly, a discharge is more quickly generated during falling period $P_{r3}$ in the driving waveform of FIG. 4 compared to the driving waveform of FIG. 3, and the erased amount of the wall charges accumulated on address electrode A is reduced, which will be described with reference to FIGS. 5 to 7.

Figure 3:
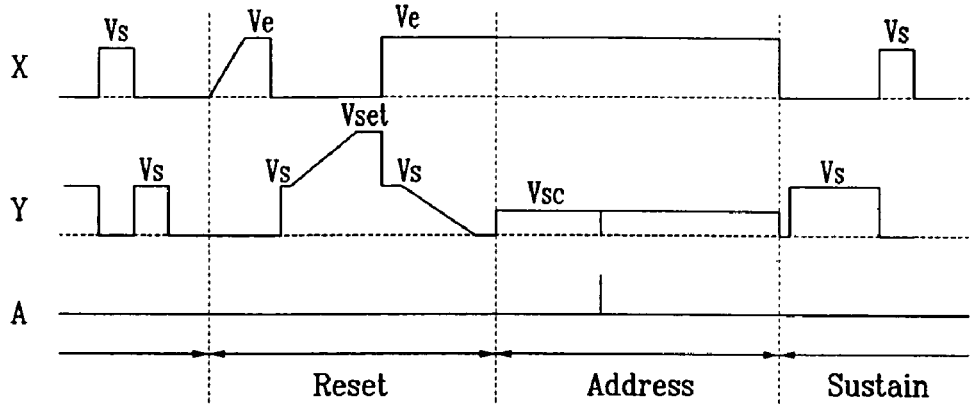
FIG.3(Prior Art)
FIG. 3 shows a conventional PDP driving waveform diagram.

First, in rising period $P_{r2}$ of FIGS. 3 and 4, a ramp voltage which gradually rises from voltage $V_s$ to voltage $V_{set}$ which is greater than a discharge firing voltage is applied to scan electrode Y, while 0V is applied to sustain electrode X and address electrode A. A weak resetting is generated from scan electrode X to address electrode A and sustain electrode X while the ramp voltage rises, and as a result, the negative wall charges are accumulated on scan electrode Y, and the positive wall charges are concurrently accumulated on address electrode A and sustain electrode X.

Figure 5:
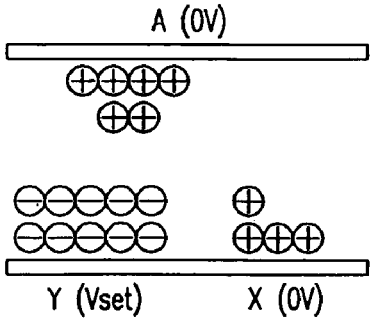
FIG. 5 shows a diagram of a wall charge distribution caused by the waveforms of FIGS. 3 and 4.

In this instance, since the potential of address electrode A has a characteristic of maintaining a middle potential between scan electrode Y and sustain electrode X, the state of the wall charges at the end part of rising period $P_{r2}$ is given as in FIG. 5. That is, the wall charges that correspond to the middle potential between the potential caused by voltage $V_{set}$ applied to scan electrode Y and the wall charges formed on scan electrode Y and the potential caused by 0V applied to sustain electrode X and the wall charges formed on sustain electrode X are formed on address electrode A.

Next, the state of the wall charges during falling period $P_{r3}$ of the driving waveform according to the first exemplary embodiment will be described with reference to FIGS. 6 and 7.

Figure 6:
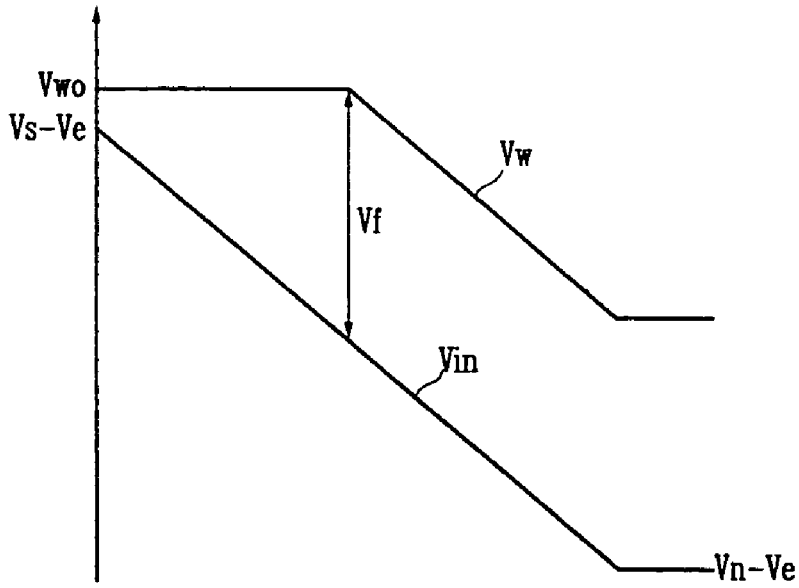
FIGS. 6 and 7 respectively show wall voltages caused by the driving waveforms of FIGS. 3 and 4, and the states of applied voltages.

First, FIG. 6 shows an internal wall voltage when a ramp voltage which falls from voltage $V_s$ to voltage $V_n$ is applied to scan electrode Y while voltage $V_e$ is applied to sustain electrode X in the like manner of falling period is $P_{r3}$ of the driving waveform shown in FIG. 3. As shown in FIG. 6, a voltage difference (referred to as an "applied voltage" hereinafter) between scan electrode Y caused by the externally applied voltage and sustain electrode X gradually falls from voltage ($V_s$–$V_e$) to voltage ($V_n$–$V_e$). When defining wall voltage $V_w$ between scan electrode Y and sustain electrode X at the last point of rising period $P_{r2}$ of FIG. 3 as $V_{w0}$, a discharge is generated when the voltage difference between voltage $V_{w0}$ and applied voltage $V_{in}$ becomes greater than discharge firing voltage $V_f$. When a gradually falling ramp voltage is applied to generate a discharge, the wall voltage within the discharge cell is reduced by the same gradient as that of applied voltage $V_{in}$. The above-described scheme is well-known in the art as disclosed by U.S. Pat. No. 5,745,086, and hence, no detailed description thereof will be provided.

Since voltage ($V_e$+$V_p$) is applied to sustain electrode X during period $P_{r31}$ of falling period $P_{r3}$, and voltage $V_e$ is applied to sustain electrode X during second period $P_{r32}$ as shown in FIG. 4, applied voltage $V_{in}$ gradually falls to voltage ($V_n$−$V_e$) from voltage ($V_s$−$V_e$−$V_p$) during first period $P_{r31}$, and applied voltage $V_{in}$ gradually falls to voltage ($V_n$−$V_e$) from voltage ($V_n$−$V_e$−$V_p$) during second period $P_{r32}$. In this instance, when the difference between initial voltage $V_{w0}$ of wall voltage $V_w$ and applied voltage $V_{in}$ becomes greater than discharge firing voltage $V_f$, a weak discharge occurs, and wall voltage $V_w$ is reduced according to the same gradient as that of applied voltage $V_{in}$. Since the difference between wall voltage $V_w$ and applied voltage $V_{in}$ is less than discharge firing voltage $V_f$ during second period $P_{r32}$, a discharge between sustain electrode X and scan electrode Y is suppressed.

Figure 7:
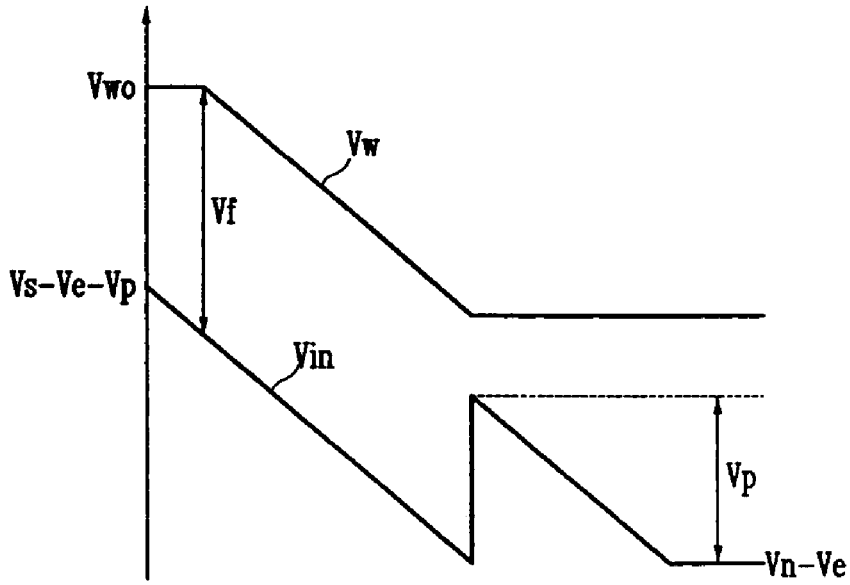

Regarding FIGS. 6 and 7, a faster discharge is generated in falling period $P_{r3}$ in the driving waveform according to the first exemplary embodiment of the present invention compared to the driving waveform of FIG. 3. In this instance, the potentials of sustain electrode X and scan electrode Y are higher than the driving waveform of FIG. 3 in the earlier part of falling period $P_{r3}$. That is, the voltage externally applied to sustain electrode X is higher than the driving waveform of FIG. 3 by voltage $V_p$, and the voltage applied to scan electrode Y at the discharge firing time is higher than the driving waveform of FIG. 3. The potentials of sustain electrode X and scan electrode Y in the driving waveform according to the first exemplary embodiment of the present invention are higher than the potential of the driving waveform of FIG. 3 while the discharge is performed and applied voltage $V_{in}$ falls with reference to the elapse time after the discharge is fired.

Therefore, the average potential of sustain electrode X and scan electrode Y while a weak discharge is generated becomes higher than the average potential in the driving waveform of FIG. 3. Since the potential of address electrode A has a characteristic of maintaining the average potential of sustain electrode X and scan electrode Y as described above, the potential of address electrode A is to be higher than the driving waveform of FIG. 3. Since the voltage applied to the address electrode A in the driving waveforms of FIGS. 3 and 4 is the same, the amount of positive wall charges formed on address electrode A becomes greater than the amount of wall charges in the driving waveform of FIG. 3. That is, less of the positive wall charges accumulated on address electrode A are lost compared to FIG. 3.

In second period $P_{r32}$ of falling period $P_{r3}$, the voltage at sustain electrode X is reduced to voltage $V_e$ again, and accordingly, the difference between wall voltage $V_w$ and applied voltage $V_{in}$ is reduced below discharge firing voltage $V_f$, and the discharge between scan electrode Y and sustain electrode X is suppressed. In second period $P_{r32}$, a discharge between scan electrode Y and address electrode A is generated through priming particles generated by the discharge between scan electrode Y and sustain electrode X. That is, in the final part of falling period $P_{r3}$, a weak discharge between scan electrode Y and address electrode A is actively generated while the discharge between scan electrode Y and sustain electrode X is suppressed, and hence, the wall voltage between scan electrode Y and address electrode A is precisely controlled.

Loss of the positive wall charges formed on address electrode A is reduced, and the wall voltage between scan electrode Y and address electrode A is precisely controlled according to the first exemplary embodiment. Accordingly, the wall voltage between address electrode A and scan electrode Y is increased, and voltage $V_a$ applied to address electrode A for selecting the discharge cell in address period $P_a$ is reduced.

That is, voltage $V_n$ is sequentially applied to scan electrode Y to select scan electrode Y in address period $P_a$ while another scan electrode Y is maintained at voltage $V_{sc}$. Address voltage $V_a$ is applied to address electrode A which forms a discharge cell to be selected from among the discharge cells formed by scan electrode Y to which voltage $V_n$ is applied. Accordingly, the address discharging is executed because of the difference between voltage $V_a$ applied to address electrode A and voltage $V_n$ applied to scan electrode Y and the wall voltage caused by the wall charges formed on address electrode A and scan electrode Y. In this instance, voltage $V_a$ is reduced since a large amount of positive wall charges are formed on address electrode A, and the wall voltage is high.

Next, a sustain pulse is sequentially applied to scan electrode Y and sustain electrode X during sustain period $P_s$. The sustain pulse functions so that the voltage difference between scan electrode Y and sustain electrode X may alternately be voltages $V_s$,−$V_s$. Voltage $V_s$ is less than the discharge firing voltage between scan electrode Y and sustain electrode X. When the wall voltage is formed between scan electrode Y and sustain electrode X because of the address discharging during address period $P_a$, a discharge is generated on scan electrode Y and sustain electrode X because of the wall voltage and voltage $V_s$. The voltage pattern of sustain electrode X is modified from voltage Vh to voltage Ve in the step pattern as shown in FIG. 4, and in addition, the voltage pattern can be varied, which will now be described with reference to FIGS. 8 and 9.

Figure 8:
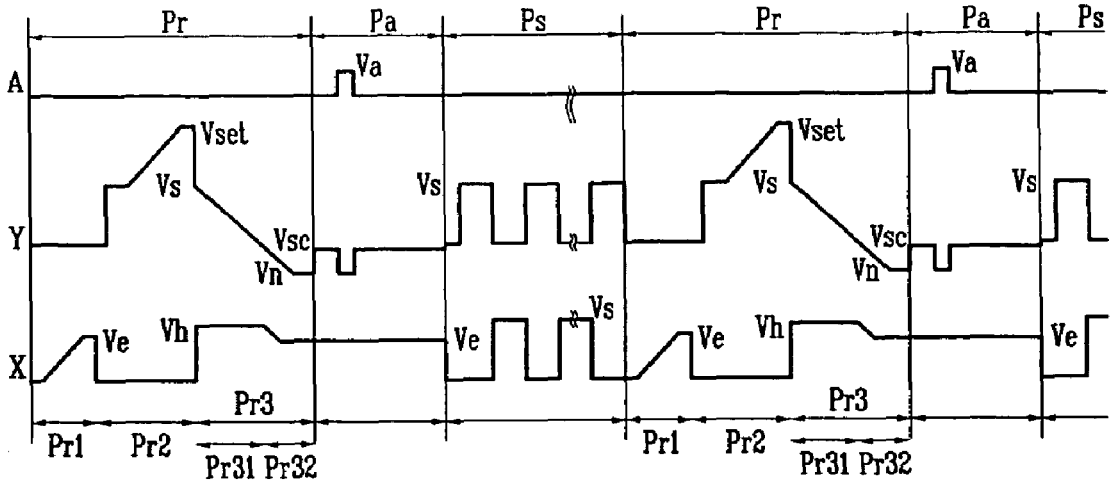
FIGS. 8 to 11 respectively show PDP driving waveform diagrams according to second to fifth exemplary embodiments of the present invention.
Figure 9:
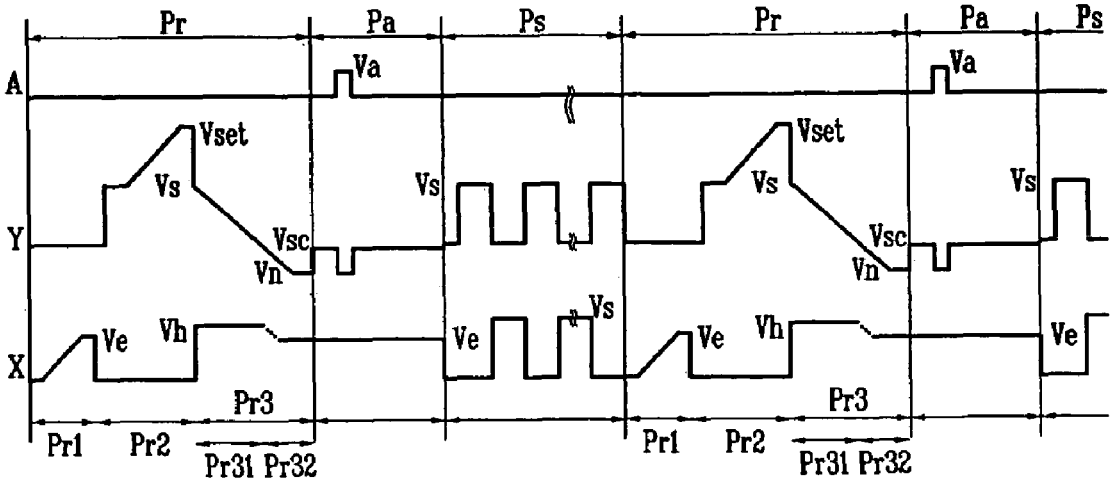

FIGS. 8 and 9 respectively show PDP driving waveform diagrams according to second and third exemplary embodiments of the present invention.

Referring to FIG. 8, the voltage applied to sustain electrode X during second period $P_{r32}$ of falling period $P_{r3}$ gradually falls to voltage $V_e$ from voltage $V_h$. In this instance, the gradient of the voltage applied to sustain electrode X is established to be equal to or steeper than the gradient of the voltage applied to scan electrode Y.

When the voltage of sustain electrode X in the ramp format falls gradually, the influence applied by the voltage variation of sustain electrode X to the voltage variation of scan electrode Y is reduced since the voltage is varied by a low-level current. That is, since a general ramp voltage generation circuit is realized to supply a low-level current, when the voltage at sustain electrode X is abruptly varied while transforming the voltage of scan electrode Y into a ramp pattern, the current is not appropriately supplied to scan electrode Y in the ramp operation, and hence, the voltage of scan electrode Y can be instantly influenced by the voltage variation of sustain electrode X. However, when the waveform of sustain electrode X is varied in the ramp pattern as shown in FIG. 8, the voltage of scan electrode Y may not be influenced by the voltage variation of sustain electrode X since a low current is required for the voltage variation.

Referring to FIG. 9, voltage $V_e$ is applied to sustain electrode X when sustain electrode X is floated for a specific time during second period $P_{r32}$ of falling period $P_{r3}$. As a result, a falling ramp is applied to scan electrode Y. Sustain electrode X, which is floated while the current flows, fails to receive the current, and hence, the potential of sustain electrode X follows the potential variation of scan electrode Y. Therefore, the waveform of sustain electrode X can be modified to the ramp pattern without a circuit for applying a ramp voltage to sustain electrode X, and hence, the bias of sustain electrode X can be varied without influencing the ramp voltage applied to scan electrode Y.

The waveforms which apply the falling ramp waveform after applying the rising ramp waveform during the reset period have been described in the first exemplary embodiment of the present invention, and differing from this, it is also possible that the driving waveform applies a rising ramp voltage and a falling ramp voltage during a main reset period and applies a falling ramp voltage during a sub reset period, which will be described in detail with reference to FIG. 10.

Figure 10:
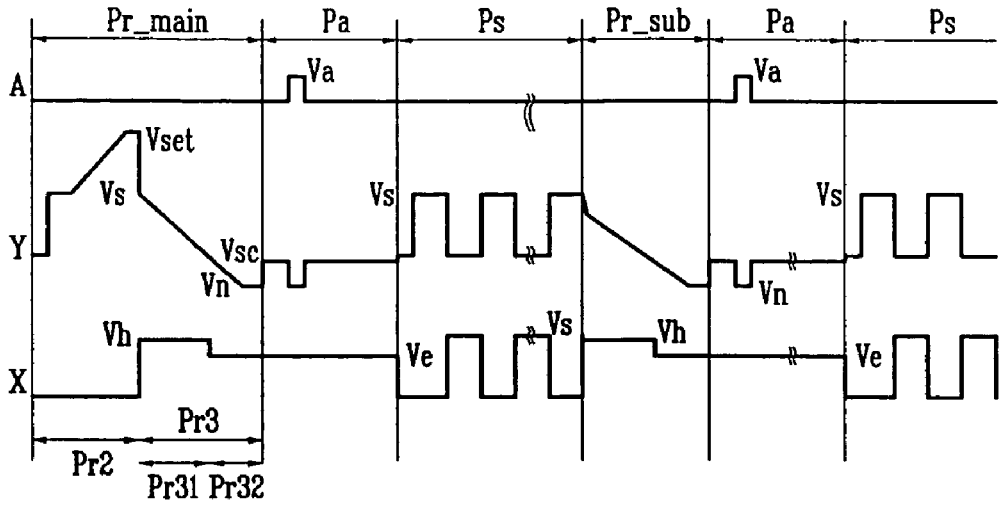

FIG. 10 shows a PDP driving waveform diagram according to the fourth exemplary embodiment of the present invention.

As shown, main reset period $P_{r_main}$ is formed in the first subfield, and sub reset period $P_{r\text{-}sub}$ is formed in a subsequent subfield from among a plurality of subfields which configure a frame in the driving waveform according to the fourth exemplary embodiment.

A rising ramp waveform is applied, and a falling ramp waveform is then applied in main reset period $P_{r_main}$ which is the reset period of the first subfield. A falling ramp waveform is only applied in sub reset period $P_{r_sub}$ which is the reset period of the subfield which is after the second subfield.

In general, a rising ramp waveform is applied to scan electrode Y so as to form a large amount of the wall charges on the discharge cell during the reset period. It is not needed to form the wall charges during the reset period in the subfield after the second subfield since a large amount of wall charges are already formed on the discharge cell, which emit light during the sustain period of the previous subfield, by the sustain discharging. Also, since no state of the wall charges formed during the reset period is varied in the discharge cell which did not emit light during the sustain period, no reset operation is required to be executed in the next subfield. The discharge cell maintains the reset state since no discharge occurs if only a falling ramp waveform is applied to scan electrode Y in this state.

In the last subfield, the wall charges formed by the sustain discharging are erased by applying the waveform which corresponds to the waveform applied in erase period $P_{r1}$ of FIG. 4 to sustain electrode X, and accordingly, the discharge cell is reset again in main reset period $P_{r\text{-}main}$ of the first subfield of a next frame. Main reset period $P_{r\text{-}main}$ is provided in the first subfield with reference to a frame in the fourth exemplary embodiment, and in addition to this, main reset period $P_{r\text{-}main}$ may be provided in another subfield.

As shown in FIG. 10, when a falling ramp voltage is applied to scan electrode Y from main reset period $P_{r\text{-}main}$ and sub reset period $P_{r_sub}$ as shown in FIG. 10, voltage $V_h$ is applied to sustain electrode X during first period $P_{r31}$, and voltage $V_e$ is applied to sustain electrode X during second period $P_{r32}$, and hence, a further amount of the wall charges are accumulated on address electrode A as described above, and the voltage applied to address electrode A during address period Pa is reduced. The voltage at sustain electrode X in the driving waveform of FIG. 10 can be varied as that shown in FIGS. 8 and 9.

The voltage which is gradually falling during the reset period has been applied to the scan electrode in the first to fourth exemplary embodiments, and differing from these, floating may be repeatedly applied to scan electrode Y during the reset period, which will be described in detail referring to FIG. 11.

Figure 11:
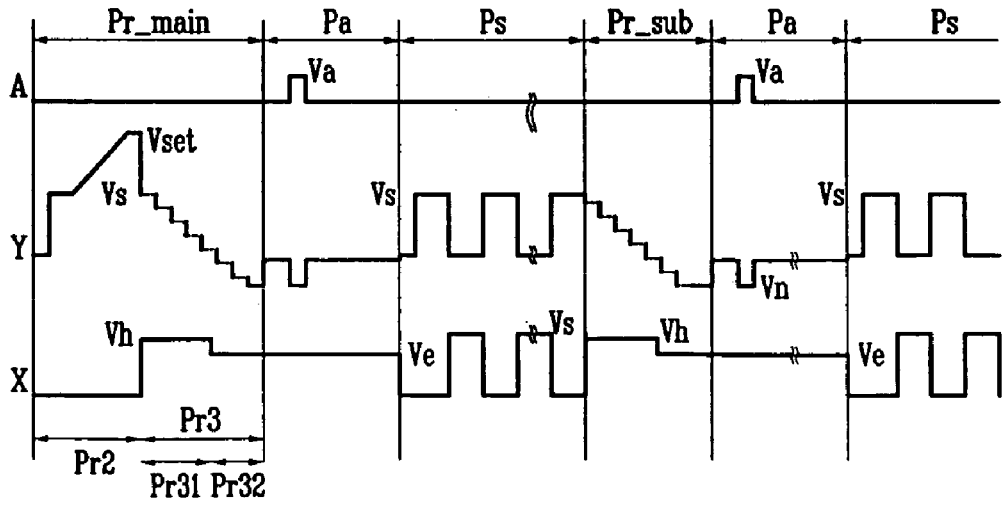

FIG. 11 shows a PDP driving waveform diagram according to a fifth exemplary embodiment of the present invention.

As shown, the falling waveform applied to scan electrode Y during the reset period repeatedly reduces a voltage by a predetermined level and floats scan electrode Y for a predetermined time in the driving waveform according to the fifth exemplary embodiment. That is, an operation for reducing the voltage applied to scan electrode Y by a predetermined level of voltage, and intercepting the voltage supplied to scan electrode Y to thus float scan electrode Y is repeated.

When a discharge is generated in the discharge cell by the voltage applied to the scan electrode while the operation is repeated, the wall charges formed in the discharge cell are erased. When scan electrode Y is floated after the discharge is fired, the voltage within the discharge cell is abruptly reduced to quench the discharge when a small amount of wall charges within the discharge cell are erased. When the voltage at scan electrode Y is reduced by a predetermined level of voltage, the discharge is fired, and when scan electrode Y is floated after the discharge is fired, the voltage within the discharge cell is abruptly reduced to quench the discharge, and accordingly, the small amount of the wall charges are erased. That is, the erased amount of the wall charges can be precisely controlled.

The wall charges within the discharge cell are erased by a small amount and controlled in the desired manner by repeatedly applying a falling voltage to scan electrode Y and floating the electrode as described above. That is, the wall charges are precisely erased by repeating the operation for erasing the wall charges by a small amount.

A strong discharge quench by the floating will be described referring to FIGS. 12A to 12D with reference to sustain electrode X and scan electrode Y in the discharge cell since the discharge is generated between sustain electrode X and scan electrode Y.

Figure 12A:
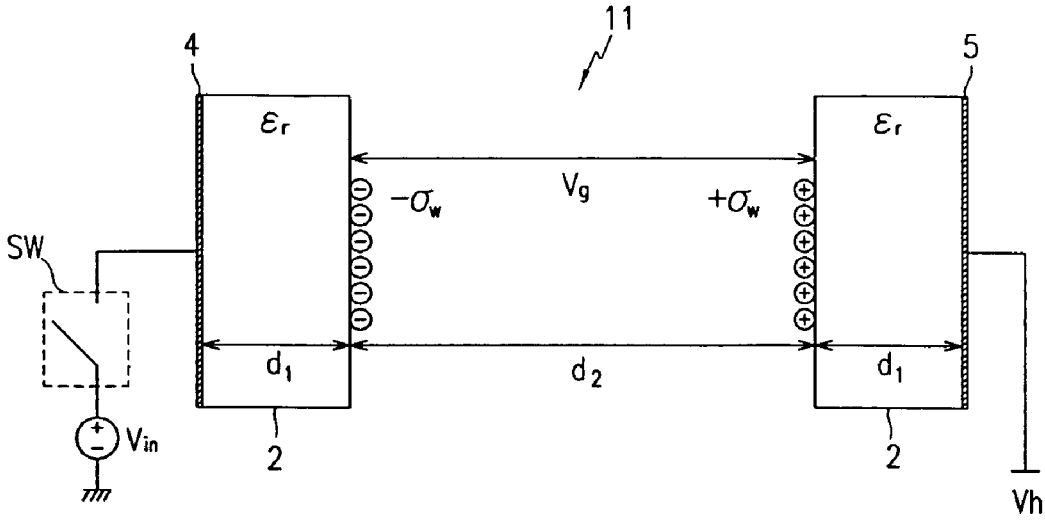
FIG. 12A shows a diagram of modeled discharge cells formed by a sustain electrode and a scan electrode.
Figure 12B:
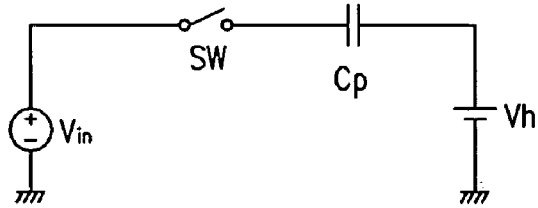
FIG. 12B shows an equivalent circuit diagram of FIG. 12A.
Figure 12C:
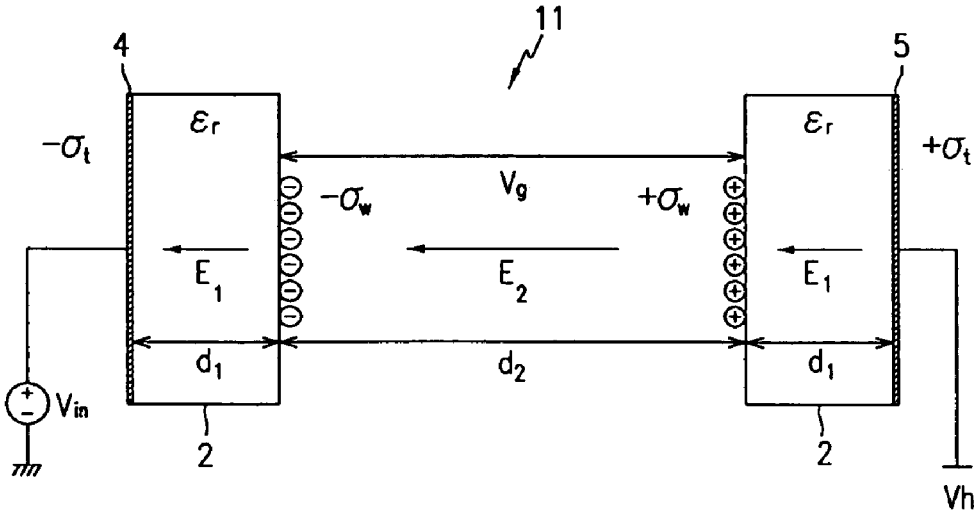
FIG. 12C shows a state in which an external voltage is applied to the discharge cells of FIG. 12A.
Figure 12D:
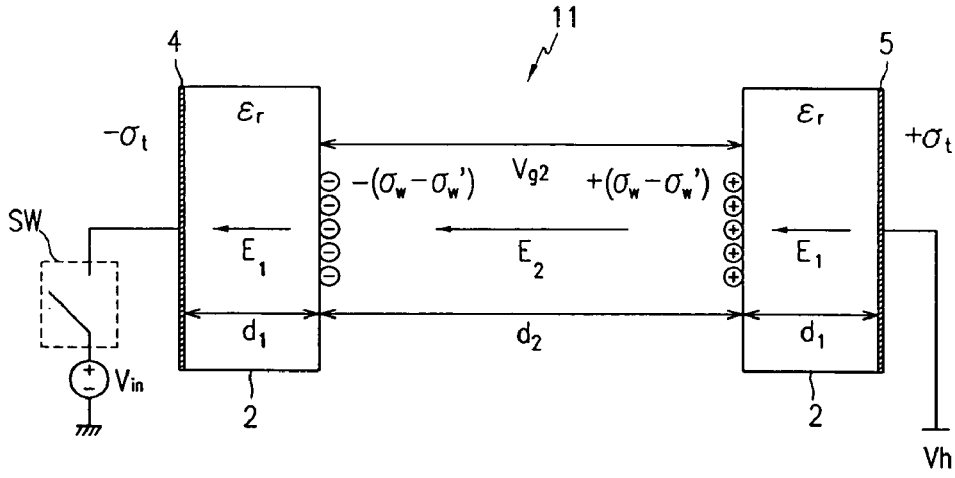
FIG. 12D shows a floated state of when the discharge cells are discharged.

FIG. 12A shows a diagram of modeled discharge cells formed by the sustain electrode and the scan electrode. FIG. 12B shows an equivalent circuit diagram of FIG. 12A. FIG. 12C shows a state in which an external voltage is applied to the discharge cells of FIG. 12A. FIG. 12D shows a floated state when the discharge cells are discharged. For ease of description, it is defined in FIG. 12A that charges $-\sigma_w$ and $+\sigma_w$ are formed on scan electrode 4 and sustain electrode 5 in the earlier stage. The charges are actually formed on the dielectric layer, but they are described to be formed on the electrodes for ease of description.

As shown in FIG. 12A, scan electrode 4 is coupled to external applied voltage $V_{in}$ through a switch SW, and sustain electrode 5 is coupled to voltage $V_h$. Dielectric layer 2 is formed in scan electrode 4 and sustain electrode 5. Discharge gas (not illustrated) is provided between dielectric layers 2, and the space between the dielectric layers 2 form discharge space 11.

In this instance, scan electrode 4, sustain electrode 5, dielectric layers 2, and discharge space 11 can be given as panel capacitor Cp, as shown in FIG. 12B since they form a capacitive load. The dielectric constant of the two dielectric layers 2 is defined as $\epsilon_r$. The voltage in discharge space 11 is given as $V_g$. The thickness of dielectric layers 2 is established to be the same, and the distance (distance of the discharge space) between the two dielectric layers 2 is set to be $d_2$.

Referring to FIG. 12C, voltage $V_{g1}$ within the discharge space when switch SW is turned on, and external voltage $V_{in}$ is applied to scan electrode 4 is calculated, assuming that charges $-\sigma_w$ and $+\sigma_w$ are applied to scan electrode 4 and sustain electrode 5 by the external applied voltage. Electric field E1 within dielectric layer 2 and electric field E2 within discharge space 11 are given in Equations 1 and 2 by applying the Gaussian law.

$$E_1 = \frac{\sigma_t}{\varepsilon_r \varepsilon_0} \quad \text{Equation 1}$$

where $\epsilon_0$ is a permittivity within the discharge space.

$$E_2 = \frac{\sigma_t + \sigma_w}{\varepsilon_0} \quad \text{Equation 2}$$

Voltage ($V_e - V_{in}$) applied to an external side is given as Equation 3 by the relation of the electric field vs. the distance, and the voltage within the discharge space is given as Equation 4 from Equations 1 to 3.

Equation 3

$$2d_1E_1 + d_2E_2 = V_h - V_{in}$$

$$\begin{aligned} V_{g1} &= d_2E_2 \quad \text{Equation 4} \\ &= \frac{\varepsilon_r d_2}{\varepsilon_r d_2 + 2d_1}(V_h - V_{in} - V_w) + V_w \\ &= \alpha(V_h - V_{in}) + (1-\alpha)V_w \end{aligned}$$

where $V_w$ is a voltage, given as $$\frac{d_2}{\varepsilon_0}\sigma_w,$$

formed by wall charges $\sigma_w$ within discharge space 11, and $\alpha$ is given as $$\frac{\varepsilon_r d_2}{\varepsilon_r d_2 + 2d_1}.$$

Next, a discharge is generated between scan electrode 4 and sustain electrode 5 by voltage $V_{in}$ externally applied to scan electrode 4. As shown in FIG. 12D, the wall charges formed on scan electrode 4 and sustain electrode 5 are quenched by the amount of $\sigma'_w$ by the discharge, switch SW is turned off, and scan electrode 4 is floated.

The charges applied to scan electrode 4 and sustain electrode 5 are maintained at $-\sigma_t$ and $+\sigma_t$ since no charges are externally applied in the floated state. In this instance, electric field E1 within dielectric layer 2 and electric field E2 within discharge space 11 are given in Equations 1 and 2 by applying the Gaussian law.

$$E_2 = \frac{\sigma_t + \sigma_w - \sigma'_w}{\varepsilon_0} \quad \text{Equation 5}$$

Calculation of voltage $V_{g2}$ within the discharge space from Equations 4 and 5 produces Equation 6.

$$V_{g2} = d_2E_2 = \alpha(V_h - V_{in}) + (1-\alpha)V_w - \frac{d_2}{\varepsilon_0}\sigma'_w \quad \text{Equation 6}$$

As can be determined from Equation 6, the voltage is dropped by the quenched wall charges when switch SW is turned off (is floated). As a result, since the voltage within discharge space 11 is steeply reduced in the floated state when a small amount of wall charges are quenched, the voltage between the electrodes becomes less than the discharge firing voltage, and the discharge is steeply quenched.

As described in the fifth exemplary embodiment, the wall charges are precisely controlled by applying a falling waveform which repeats applying of the voltage and floating to scan electrode Y during the reset period. As a result, minute control of the wall charges is possible since the discharge is quenched by erasing the wall charges which are very much less than the conventional amount. The resetting caused by the continuously falling ramp waveform makes the voltage applied to the discharge space gradually fall through a constant voltage variation to thereby prevent the strong discharge and control the wall charges. Since the above-noted ramp voltage controls the intensity of the discharge by the gradients of the ramp, the resetting time is increased because restricted conditions of the ramp voltage gradients for controlling the wall charges is very difficult. However, the resetting of using the floating as described in the fifth embodiment reduces the resetting time since it uses a voltage dropping principle for the intensity of the discharge according to erasure of the wall charges.

The amount of the wall charges quenched on address electrode A is reduced by applying voltage $V_e$ to sustain electrode Y after applying voltage $V_h$ thereto while the falling waveform is applied to scan electrode Y in the fifth exemplary embodiment in the same manner as the first to fourth exemplary embodiments.

As shown in FIGS. 4, 8, 9, 10, and 11 according to the first to fifth exemplary embodiments of the present invention, sustain electrode X in address period $P_a$ is biased with the same voltage as voltage $V_e$ at sustain electrode X in second period $P_{r32}$ of falling period $P_{r3}$, and in addition to this, the voltage at sustain voltage X in address period $P_a$ can be established to be greater than voltage $V_e$ at sustain electrode X, which will be described with reference to FIG. 13.

Figure 13:
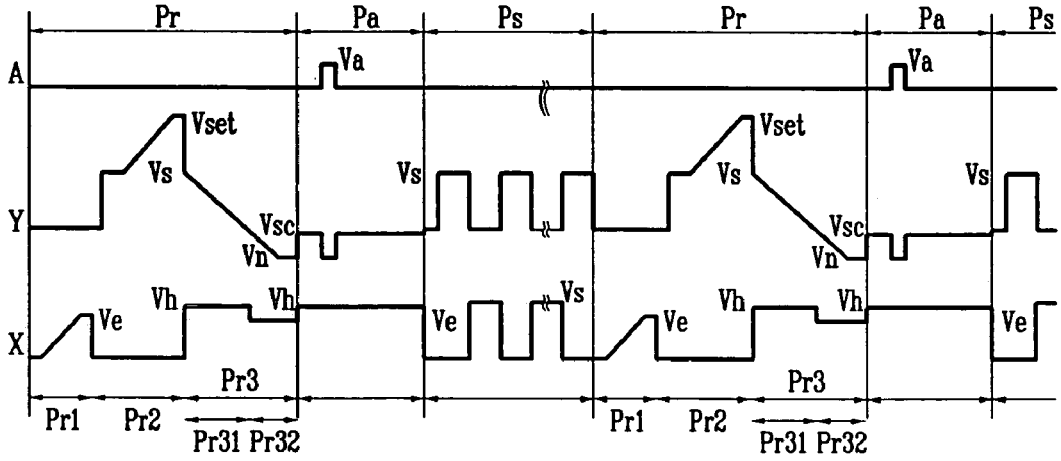
FIG. 13 shows a PDP driving waveform diagram according to a sixth exemplary embodiment of the present invention.

FIG. 13 shows a PDP driving waveform diagram according to a sixth exemplary embodiment of the present invention. As shown, the driving waveform according to the sixth exemplary embodiment has the same pattern as that of FIG. 4 except for the voltage at sustain electrode X in address period $P_a$. In more detail, a voltage which is greater than voltage $V_e$ applied to sustain electrode X in second period $P_{r32}$ of falling period $P_{r3}$ is applied to sustain electrode X in address period $P_a$. The voltage is illustrated in FIG. 13 to correspond to voltage $V_h$ applied to sustain electrode X in first period $P_{r31}$ of falling period $P_3$. As a result, there is no need to add a power source for supplying a voltage greater than voltage $V_e$.

When voltage $V_h$ is applied to sustain electrode X in the case where voltage $V_{sc}$ is sequentially applied to scan electrode Y in address period $P_a$, the voltage (which includes a wall voltage caused by the wall charges) of between sustain electrode X and scan electrode Y when voltage $V_n$ is applied to scan electrode Y in address period $P_a$ becomes greater than the voltage (which includes a wall voltage caused by the wall charges) between sustain electrode X and scan electrode Y in the final state of falling period $P_{r3}$. Since is the voltage which is greater than the voltage established in reset period P is applied between sustain electrode X and scan electrode Y, the address discharge is stably generated.

Further, the voltage at sustain electrode X described referring to FIG. 13 can be applicable to the driving waveforms of FIGS. 8 to 11.

Voltage $V_h$ used through the first to sixth exemplary embodiments may be a voltage with the same level as that of voltage $V_s$ applied to scan electrode X and sustain electrode X in sustain period $P_s$, and there is no need to add a power source for supplying voltage $V_h$ in this case.

According to embodiments of the present invention, the quenched amount of the wall charges on the address electrode during the reset period is reduced, and hence, the voltage applied to the address electrode during the address period is reduced.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A method for driving a plasma display panel having a plurality of first electrodes and second electrodes in parallel, and a plurality of third electrodes crossing the first electrodes and the second electrodes, wherein an adjacent first electrode and second electrode, and an address electrode discharge a discharge cell, comprising:

gradually reducing a voltage at the first electrode to a second voltage from a first voltage in a reset period; and respectively applying a third voltage and a fourth voltage to the first electrode and the third electrode of the discharge cell to be selected from among discharge cells in an address period, wherein the second electrode is maintained at a fifth voltage for a time period, and a sixth voltage less than the fifth voltage is applied to the second electrode while the voltage at the first electrode falls to the second voltage from the first voltage.

2. The method of claim 1, wherein the first electrode is a scan electrode, the second electrode is a sustain electrode, and the third electrode is an address electrode.

3. The method of claim 1, wherein the sixth voltage is a voltage having a same level as a voltage applied to the second electrode during the address period.

4. The method of claim 1, wherein a voltage applied to the second electrode is varied stepwise from the sixth voltage to the fifth voltage.

5. A plasma display device comprising:

a plasma display panel having a plurality of first electrodes and second electrodes in parallel, and a plurality of third electrodes crossing the first electrodes and second electrodes; and a driving circuit for applying driving signals to the first electrodes, second electrodes, and third electrodes, wherein the driving circuit gradually reduces a voltage at the first electrode from a first voltage to a second voltage, and modifies a voltage at the second electrode from a third voltage to a fourth voltage while the voltage at the first electrode is varied to the second voltage from the first voltage, the fourth voltage being less than the third voltage.

6. The plasma display device of claim 5, wherein the voltage at the first electrode gradually falls to the second voltage from the first voltage on at least one slope.

7. The plasma display device of claim 5, wherein the second electrode is maintained at the third voltage for a time period while the voltage at the first electrode is varied to the second voltage from the first voltage.

8. The plasma display device of claim 7, wherein the voltage at the second electrode is varied stepwise from the third voltage to the fourth voltage.

9. The plasma display device of claim 5, wherein the driving circuit applies the fourth voltage to the second electrode during a address period.

* * * * *